US007808453B2

(12) United States Patent
Nagaoka et al.

(10) Patent No.: US 7,808,453 B2
(45) Date of Patent: Oct. 5, 2010

(54) DRIVING METHOD OF PLASMA DISPLAY PANEL AND PLASMA DISPLAY DEVICE

(75) Inventors: Keishin Nagaoka, Kawasaki (JP); Yoshikazu Kanazawa, Kawasaki (JP); Naoki Itokawa, Yokohama (JP)

(73) Assignee: Fujitsu Hitachi Plasma Display Limited, Miyazaki-Ken (JP)

( * ) Notice: Subject to any disclaimer, the term of this patent is extended or adjusted under 35 U.S.C. 154(b) by 796 days.

(21) Appl. No.: 11/746,671

(22) Filed: May 10, 2007

(65) Prior Publication Data

US 2008/0055199 A1 Mar. 6, 2008

(30) Foreign Application Priority Data

Sep. 1, 2006 (JP) ..... 2006-237464

(51) Int. Cl.
*G09G 3/28* (2006.01)

(52) U.S. Cl. ..... 345/68; 315/169.4

(58) Field of Classification Search ..... 345/60–72, 345/204–214; 315/169.3, 169.4
See application file for complete search history.

(56) References Cited

U.S. PATENT DOCUMENTS 6,744,218 B2 6/2004 Kang et al.
6,922,191 B2 7/2005 Watanabe
7,446,735 B2 * 11/2008 Kim et al. ..... 345/60
2005/0116891 A1 * 6/2005 Han ..... 345/60
2006/0097963 A1 * 5/2006 Lee ..... 345/63
2006/0279485 A1 * 12/2006 Kang ..... 345/67
2009/0153535 A1 * 6/2009 Kaminaka et al. ..... 345/208

FOREIGN PATENT DOCUMENTS

JP 11-065514 3/1999
JP 2001-013913 1/2001
JP 2001-184024 7/2001
JP 3242096 B 10/2001
JP 2005-338120 12/2005
KR 2003-0082731 10/2003

* cited by examiner

*Primary Examiner*—David L Lewis
(74) *Attorney, Agent, or Firm*—Antonelli, Terry, Stout & Kraus, LLP

(57) ABSTRACT

In a sustain operation in an ALIS PDP device, a combination in which a basic first waveform and a second waveform in which a discharge peak is separated are mixed is applied. In the combination, the probability that the second waveform occurs successively is sufficiently reduced to less than 20%, and the number of times of sustain discharges of various intensities is made equal in the lines to be driven. By this means, the 2L nonuniformity can be prevented, and the deterioration of Vsmin can be reduced.

12 Claims, 10 Drawing Sheets

<1>

<2>

<3>

DRIVING METHOD OF PLASMA DISPLAY PANEL AND PLASMA DISPLAY DEVICE

CROSS-REFERENCE TO RELATED APPLICATION

The present application claims priority from Japanese Patent Application No. JP 2006-237464 filed on Sep. 1, 2006, the content of which is hereby incorporated by reference into this application.

TECHNICAL FIELD OF THE INVENTION

The present invention relates to a technology for a display device (plasma display device: PDP device) provided with a plasma display panel (PDP). More particularly, it relates to the discharge and driving waveform thereof in a sustain operation of the drive control in a subfield.

BACKGROUND OF THE INVENTION

As one of the technological problems in the conventional PDP device, luminous efficacy [lm/W] has to be improved for the reduction of power consumption and the increase of luminance. One example of a method for improving the luminous efficacy is described in Japanese Patent No. 3242096 (Patent Document 1). In this method, in the sustain discharge in a sustain operation of the drive control in a subfield, the peak of the discharge emission is separated into to peaks, thereby achieving the improvement of luminous efficacy.

As an example of the conventional sustain operation, a driving waveform for the basic sustain discharge (referred to as first-type waveform (A)) is shown in FIG. 6. In this operation, for a single driving waveform (Px/Py), the discharge emission (E) forms one peak, that is, almost one discharge peak (511) is formed (timing t4). The applied voltage value of the driving waveform (Px/Py) ranges from −Vs (negative sustain voltage) to Vs (positive sustain voltage).

As another example of the conventional sustain operation other than the waveform (A), a driving waveform for the sustain discharge in which the peak of the discharge emission is separated into two peaks (referred to as second-type waveform (B)) as described in the Patent Document 1 is shown in FIG. 7. In this operation, for a single driving waveform (Px/Py), the discharge emission (E) forms two separate discharge peaks (521 and 522) (timing t11 and t14).

SUMMARY OF THE INVENTION

In a structure of a PDP device where the second-type waveform (B) is used for all of the waveforms of the sustain discharges (sustain pulse) in a period of a sustain operation, the maximum effect for the improvement of the luminous efficacy can be obtained. In this structure, however, such a side effect (disadvantage) that the minimum necessary sustain voltage (referred to as Vsmin) for stably discharging all the cells is increased occurs due to the weakening of discharge (overall weakening of sustain discharge including both the two discharge peaks).

For the disadvantage mentioned above, the methods (for example, (1) to (3) described below) where the first-type waveform (A) and the second-type waveform (B) are appropriately mixed and used in a sustain operation to improve the luminous efficacy without deteriorating the minimum necessary sustain voltage (Vsmin) have been devised and used in general.

(1) In an example shown in FIG. 10 (referred to as first conventional technology), in an ALIS PDP device, the waveforms A and B are alternately applied to the display electrodes (X and Y electrodes) at a rate of 1:1. In this first conventional technology, since discharge of the waveform (B) does not occur successively, the side effect of the deterioration of the minimum necessary sustain voltage (Vsmin) can be prevented. However, in the case where the first conventional technology is applied to the ALIS system as shown in FIG. 10, a significant problem occurs in image quality. This is because, since the impedance is different in the drive circuit of the Y electrode and the drive circuit of the X electrode, the single luminance (emission luminance of one sustain discharge by sustain pulse pair) differs even under the same conditions.

More specifically, in spite of the sustain discharges by the application of the same waveform B, the discharge (y) is slightly stronger and brighter than the discharge (x). Accordingly, in the driving line (L) group, one line becomes a bright line and the other line becomes a dark line in every 2L, that is, striped patterns due to the luminance nonuniformity (referred to as 2L nonuniformity) are observed.

(2) In an example shown in FIG. 11 (referred to as second conventional technology), in an ALIS PDP device, one combination of the waveforms A and B, that is, the combination C=[ABB] (application in order of A, B, B) is repeatedly applied to the display electrodes (X and Y electrodes). By this means, three types of discharges, that is, the discharge of the waveform A, the relatively strong discharge of the waveform B (y), and the relatively weak discharge of the waveform B (x) are generated. In this case, since the number of waveforms constituting one combination (C=[ABB]) is an odd number (three), the number of times of the three types of discharges is equal in the driving line group. Accordingly, the second conventional technology has the advantage that the 2L nonuniformity mentioned above does not occur. However, since the discharges of the waveform B (x and y) occur successively, the minimum necessary sustain voltage (Vsmin) is deteriorated, and is not practical.

(3) The example shown in FIG. 12 (referred to as third conventional technology) is described in Japanese Patent Application Laid-Open Publication No. 2001-13913 (Patent Document 2), in which two types of waveforms (sustain pair) are alternately applied. In this case, two sustain pairs (sub-combination), that is, p1=[AB] (application in order of A, B) and p2=[BA] (application in order of B, A) are applied alternately and repeatedly. In other words, one combination (main combination) of C=[ABBA] (application in order of A, B, B, A) including the above-mentioned elements (p1 and p2) is repeatedly outputted. The third conventional technology also has the advantage and disadvantage similar to those of the second conventional technology.

As described above, when the conventional technologies mentioned above are applied to the ALIS PDP device, the disadvantage of either the 2L nonuniformity or the Vsmin deterioration occurs, and the mass production and the practical application thereof are difficult.

The present invention has been made in consideration of the above-described problems, and an object of the present invention is to provide a technology capable of improving the luminous efficacy by suppressing or preventing such disadvantages as the 2L nonuniformity and the deterioration of Vsmin in the case where the sustain operation is performed by combining different waveforms in an ALIS PDP device.

The typical ones of the inventions disclosed in this application will be briefly described as follows. In order to achieve the object described above, the present invention is the technology for driving a PDP provided with at least two types of electrodes (X and Y electrodes) for performing the sustain discharge, and it is characterized by comprising the following technological means. In the PDP device, driving waveforms are applied to the electrodes of the PDP from a circuit unit such as a driving circuit, thereby generating discharges between the electrodes. The operation for generating the discharge by applying the driving waveforms is, for example, a sustain operation in which sustain discharge is generated specified number of times between the X and Y electrodes by repeatedly applying a single waveform (sustain pulse) pair to the X and Y electrodes.

In the PDP driving method and the PDP device for performing the method according to the present invention, different types of waveforms for generating sustain discharge such as the waveform A and the waveform B mentioned above are mixed to form a waveform unit of a periodic combination, and the waveform unit is applied to the target electrodes to generate the sustain discharge group. By the application of plural types of waveforms, plural types of discharges are generated. Then, in this structure, the probability that the waveform B (type of waveform which generates a relatively weak discharge) occurs successively is sufficiently lowered. By this means, the deterioration of the minimum necessary sustain voltage (Vsmin) is suppressed or prevented. Furthermore, the number of times of the discharges of various intensities and the total luminance are made almost equal in the driving line group, for example, in the odd-numbered/even-numbered lines in the interlace drive of the ALIS system. Accordingly, the luminance nonuniformity between driving lines, in particular, the occurrence of the 2L nonuniformity in the interlace drive of the ALIS system can be suppressed or prevented.

More specifically, as an example of the combination, after p1=[AB] (application in order of A, B) is repeatedly applied twice or more instead of once, p2=[BA] (application in order of B, A) is repeatedly applied twice or more in the same manner. This combination (C1) is expressed as C1=[[AB]×k][[BA]×k](×k: repetition of twice or more). In this case, the numbers of [AB] and [BA] are equal to each other in C1 and the number of times of the discharges of various intensities is equal in the driving line group. By this means, the occurrence of the 2L nonuniformity can be prevented, and there are few points where the waveform B occurs successively in C1, that is, the probability that the waveform B occurs successively is low. Therefore, the deterioration of Vsmin can be prevented.

(1) The driving method of a PDP according to the present invention has the following structure. In the driving waveforms for sustain discharges between two types of electrodes, which are applied to the two types of electrode repeatedly while alternately inverting its polarity in a sustain operation, a periodic first combination formed of a plurality of successive waveforms in which at least two or more types of waveforms (sustain discharge waveform) including a first-type waveform (A) and a second-type waveform (B) are mixed is repeatedly generated and applied. The first combination includes a plurality of, more typically, two (former and latter) of subsidiary combinations (sub-combination) with a shorter period (for example, [AB×k] and [BA×k]). Alternatively, the first combination includes at least two types of (two stages of) subsidiary combinations with different periods (for example, [AB] and [AB×k]). The feature of this method lies in that the probability that the second-type waveform occurs successively in the first combination is less than 20%. Furthermore, in the first combination, the number of times of the sustain discharges of various intensities by the two or more types of waveforms and the total luminance thereof are made almost equal in the display lines to be driven.

(2) Also, in this PDP driving method, the first combination is applied without breaking the first combination between the subfields of a field.

(3) Further, in this PDP driving method, in the structure of the first combination and its repetition, only at the point where the waveform (B) occurs successively, the latter waveform (B) is changed to the waveform (A), thereby eliminating the point where the waveform (B) occurs successively.

The effects obtained by typical aspects of the present invention will be briefly described below. According to the present invention, in the case where the sustain operation is to be performed by mixing different waveforms in the ALIS PDP device, the problems of the 2L nonuniformity and the deterioration of Vsmin can be suppressed or prevented, thereby improving the luminous efficacy. In particular, in the case of using the structure where the discharge peak is separated (waveform B), the effect thereof, that is, the improvement of the luminous efficacy can be realized.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings (FIG. 1 to FIG. 12). Note that components having the same function are denoted by the same reference symbols throughout the drawings for describing the embodiment, and the repetitive description thereof will be omitted.

Figure 1:
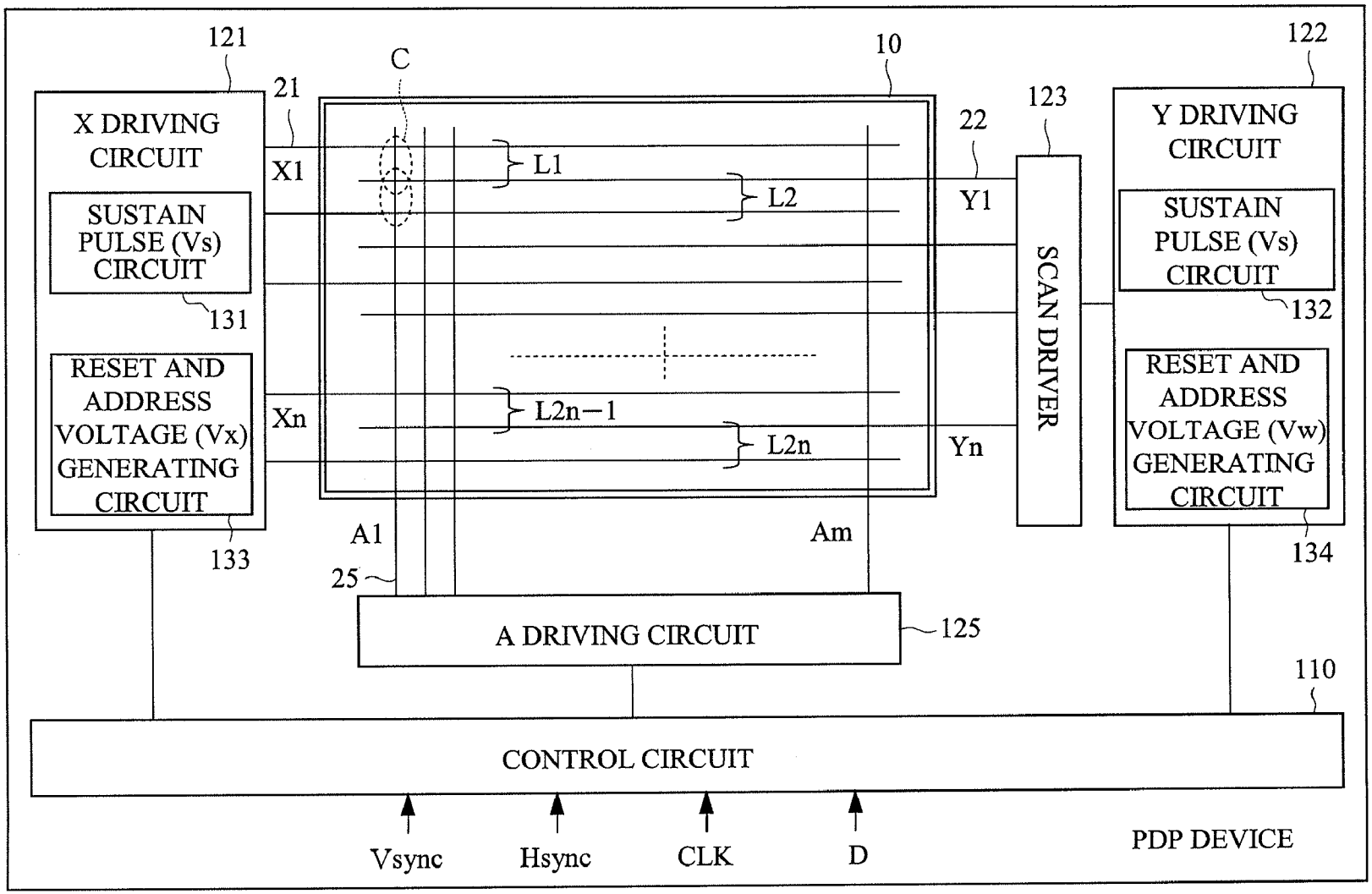
FIG. 1 is a diagram showing an overall block structure of a PDP device according to an embodiment of the present invention.
Figure 2:
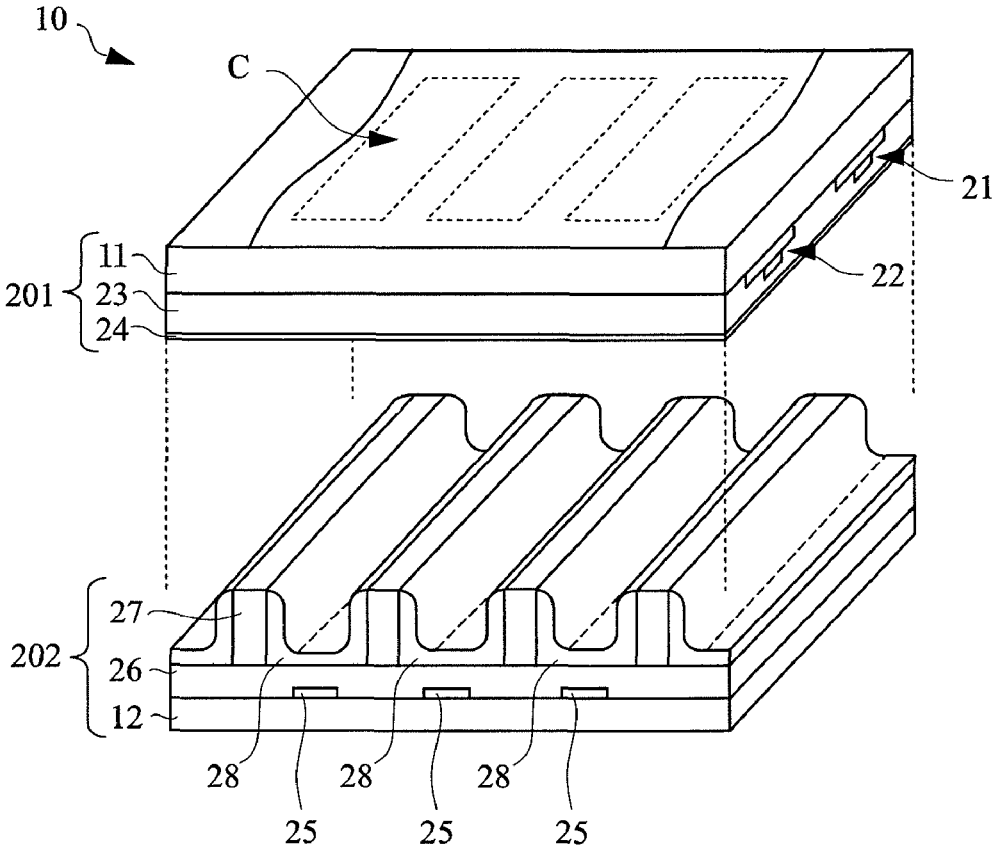
FIG. 2 is a diagram showing an example of the structure of a PDP panel in a PDP device according to an embodiment of the present invention.
Figure 3:
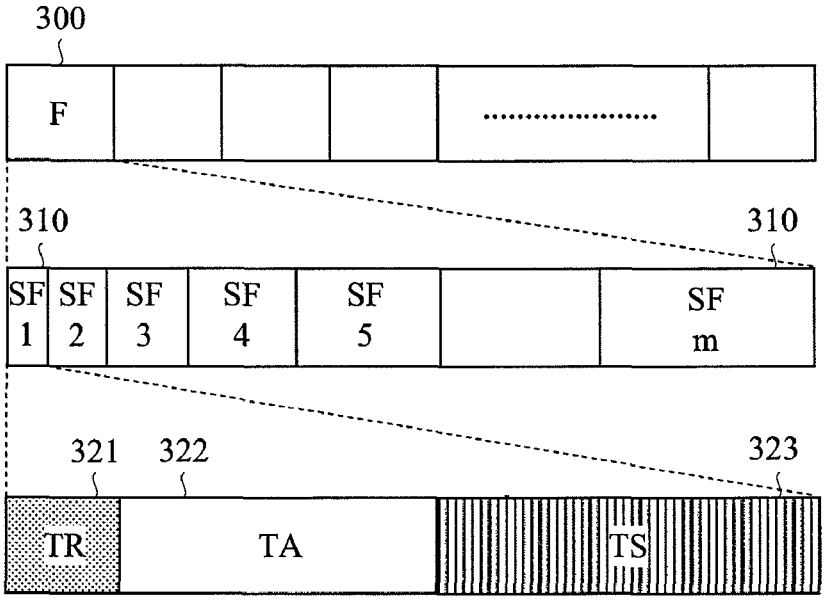
FIG. 3 is a diagram showing a structure of a field and subfield in a PDP device according an embodiment of the present invention.
Figure 4:
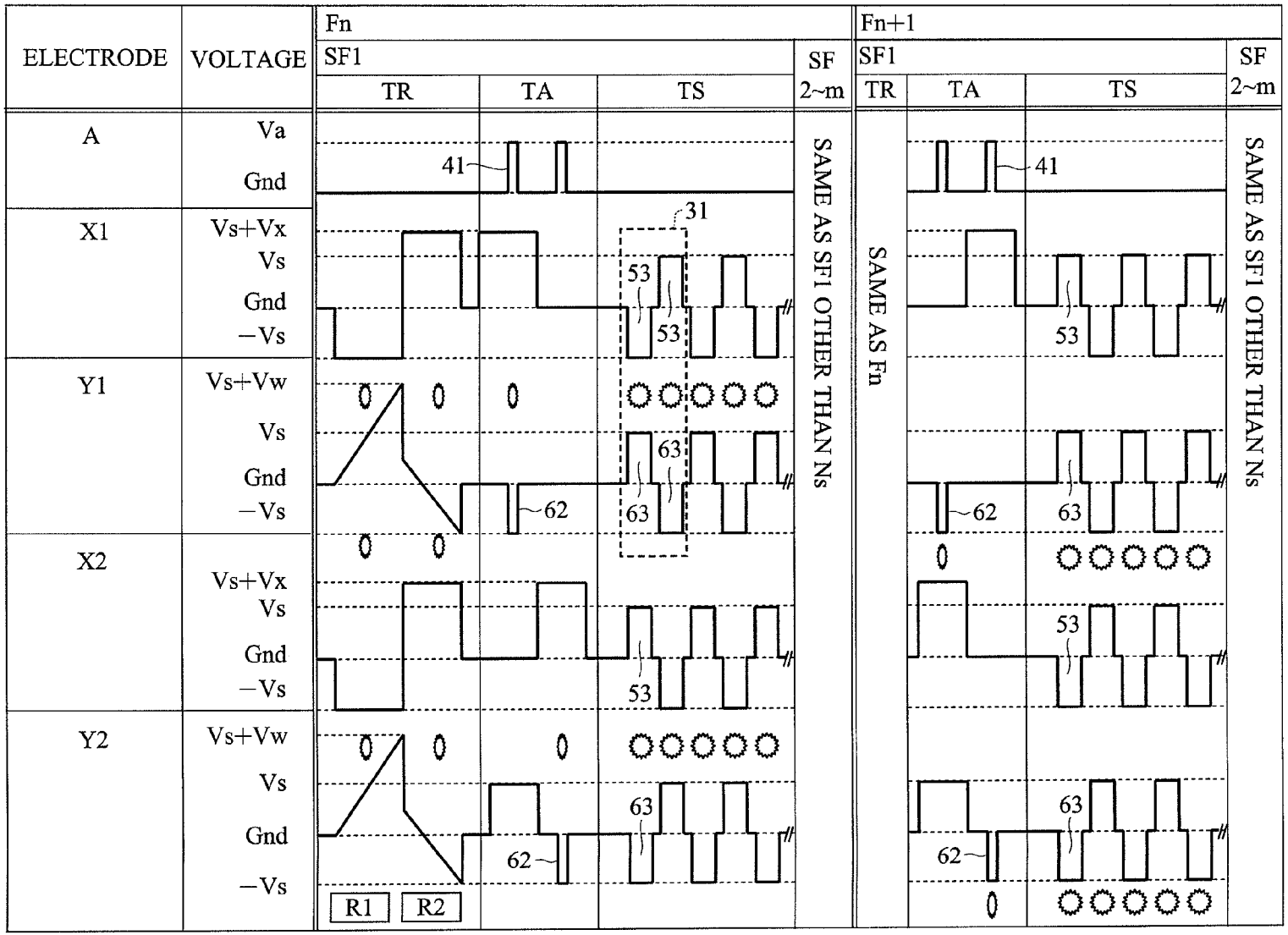
FIG. 4 is a diagram showing an example of the waveforms of a PDP in a PDP device according to an embodiment of the present invention.
Figure 5:
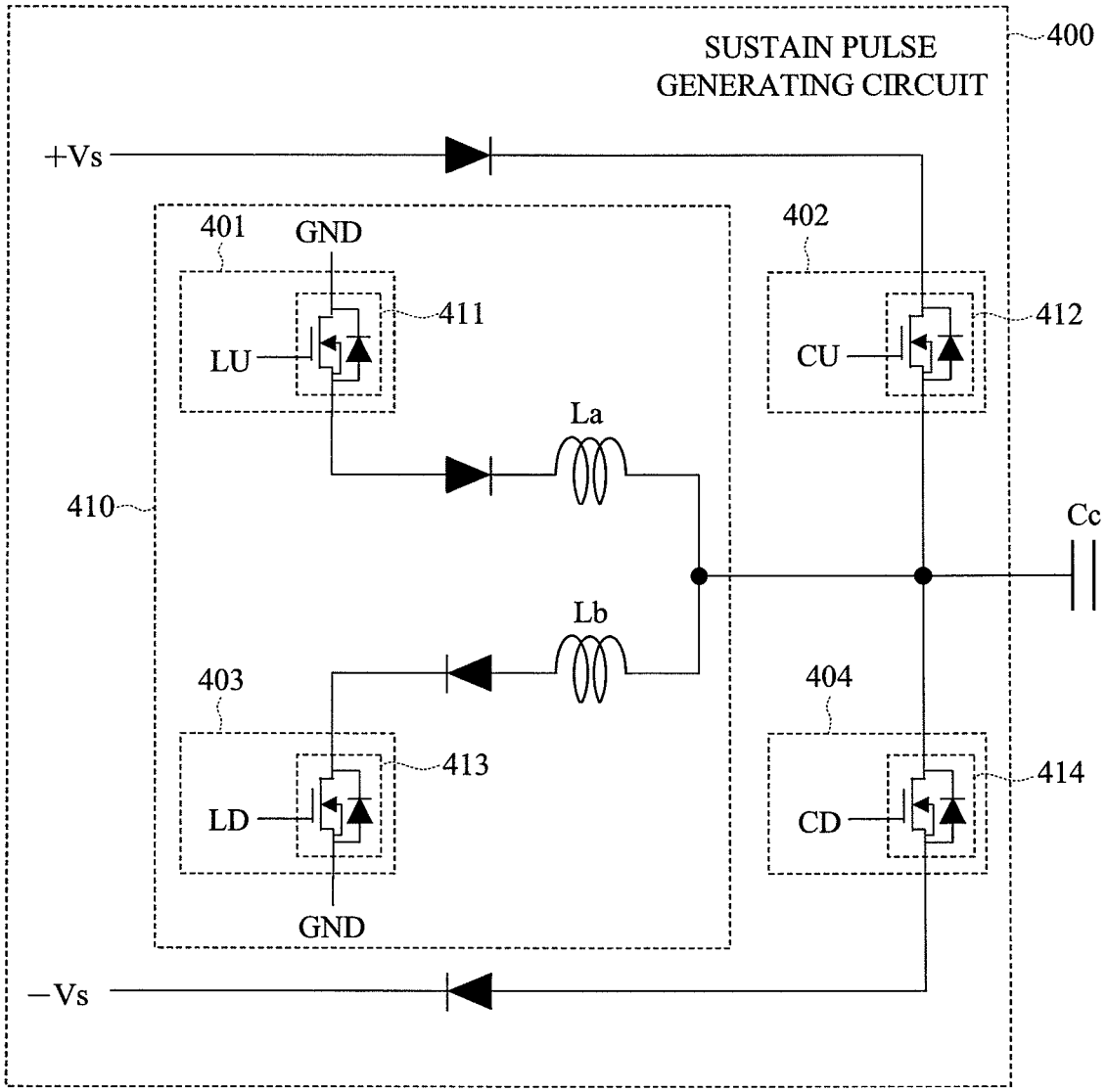
FIG. 5 is a diagram showing a structure of a sustain pulse generating circuit in a PDP device according to an embodiment of the present invention.
Figure 6:
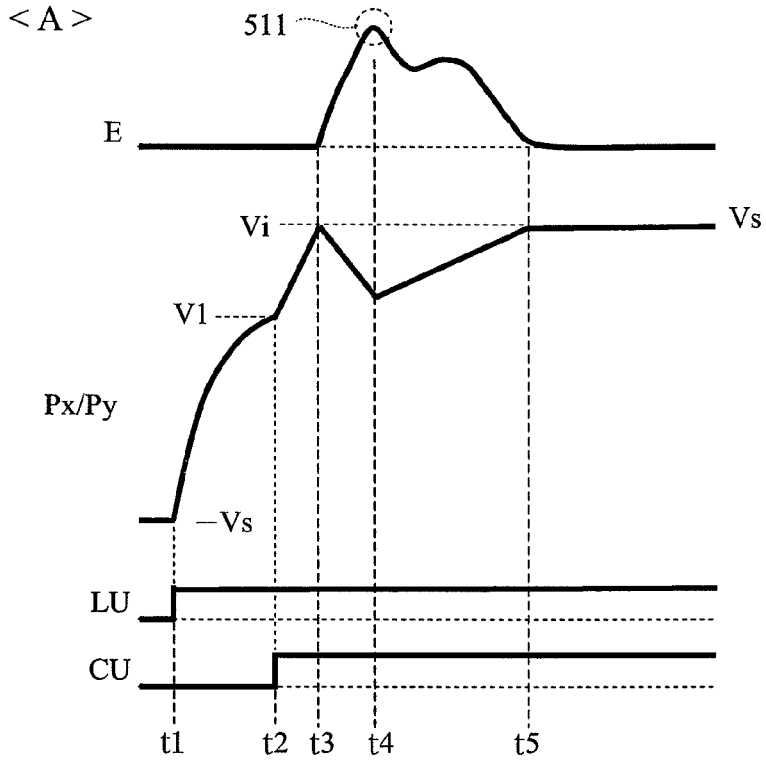
FIG. 6 is a diagram showing a sustain discharge emission and a sustain pulse (rising part) in a sustain operation and a switch control operation by the first-type waveform (A) as a conventional technology to be a constituent element in a PDP device of an embodiment of the present invention.
Figure 7:
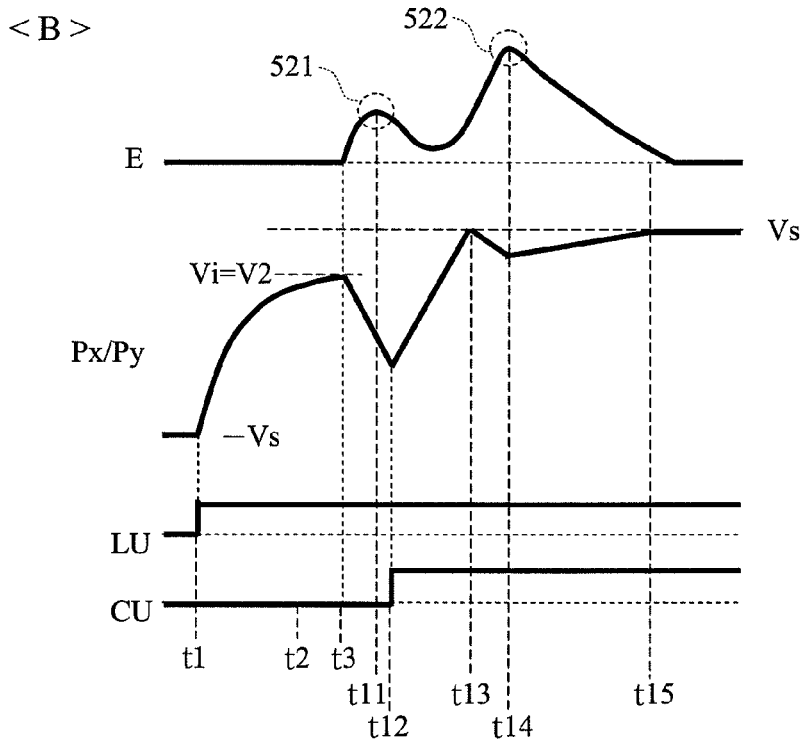
FIG. 7 is a diagram showing a sustain discharge emission and a sustain pulse (rising part) in a sustain operation and a switch control operation by the second-type waveform (B) as a conventional technology to be a constituent element in a PDP device of an embodiment of the present invention.
Figure 8:
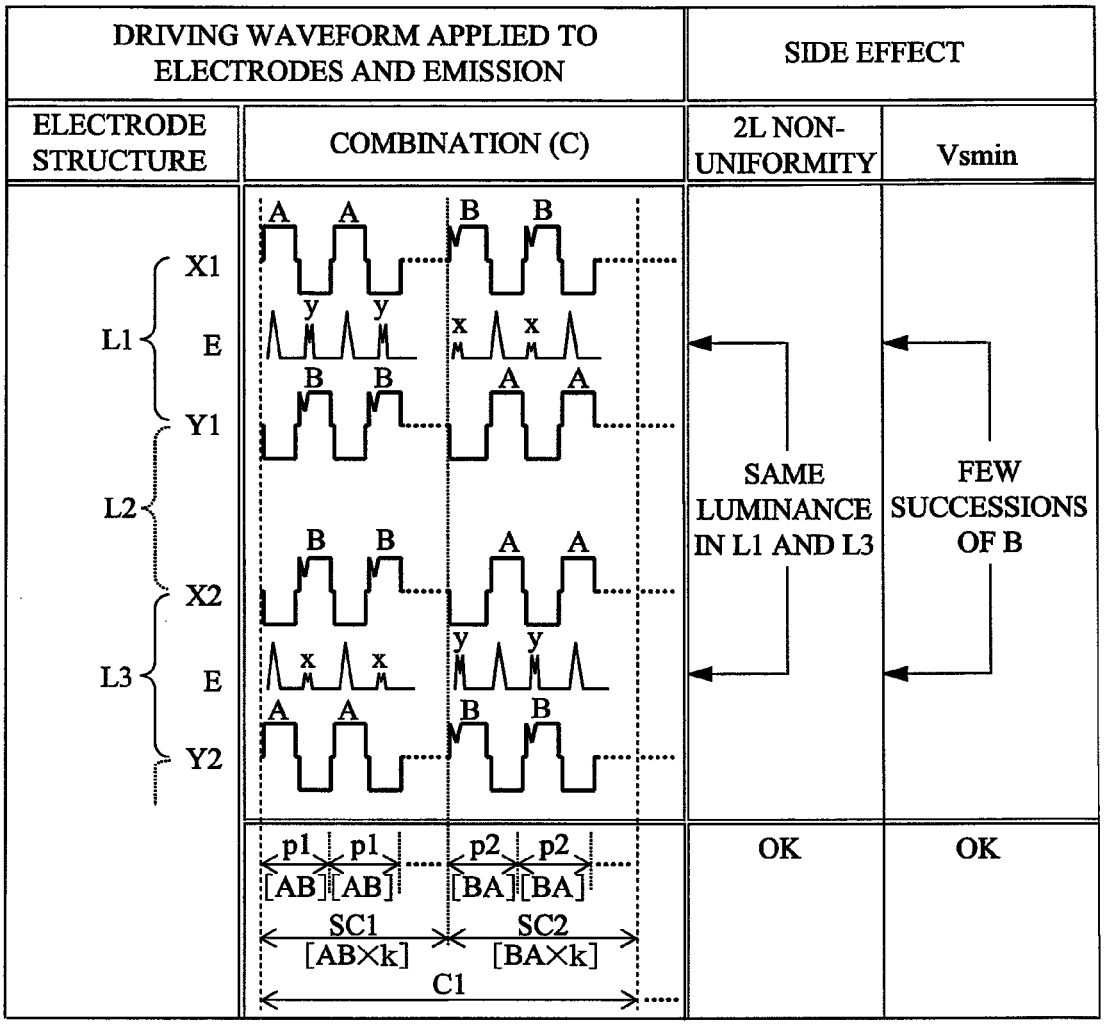
FIG. 8 is a diagram showing driving waveforms applied to electrodes, discharge emission, combination, effects and others as a sustain operation in a PDP device according to the first embodiment of the present invention.
Figure 9:
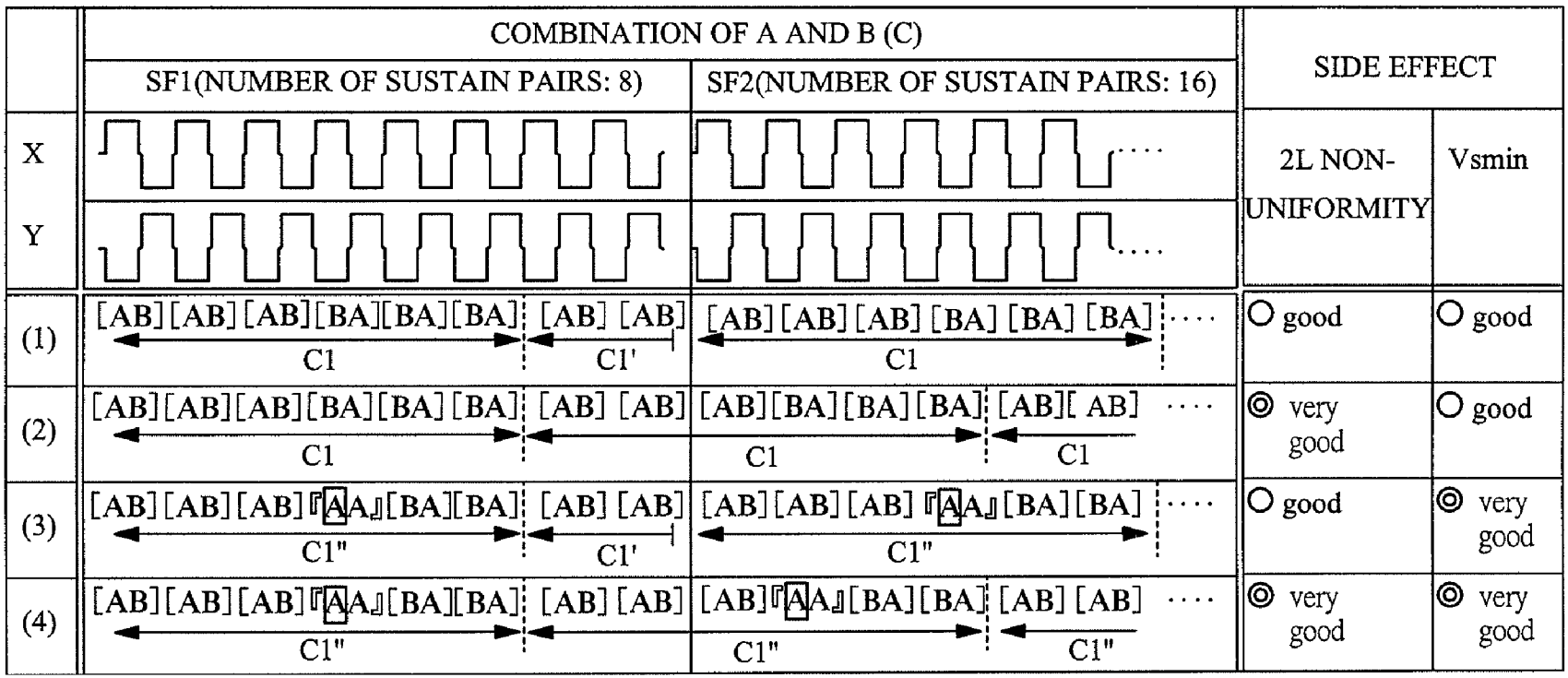
FIG. 9 is a diagram showing combinations between subfields, effects and others as a sustain operation in a PDP device according to the second to fourth embodiments of the present invention.
Figure 10:
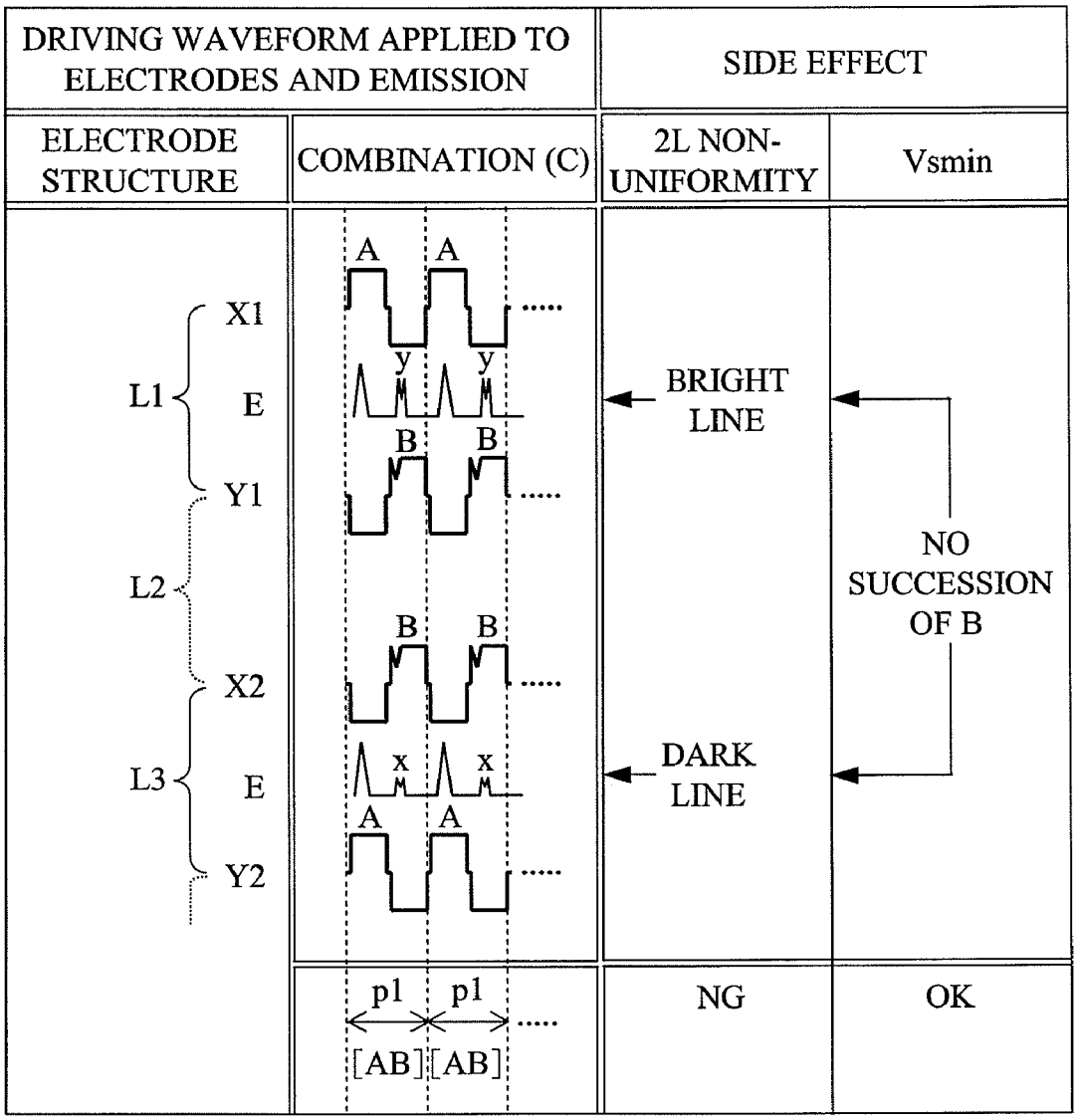
FIG. 10 is a diagram showing driving waveforms applied to electrodes, discharge emission, combination, effects and others as a sustain operation in the first conventional technology.
Figure 11:
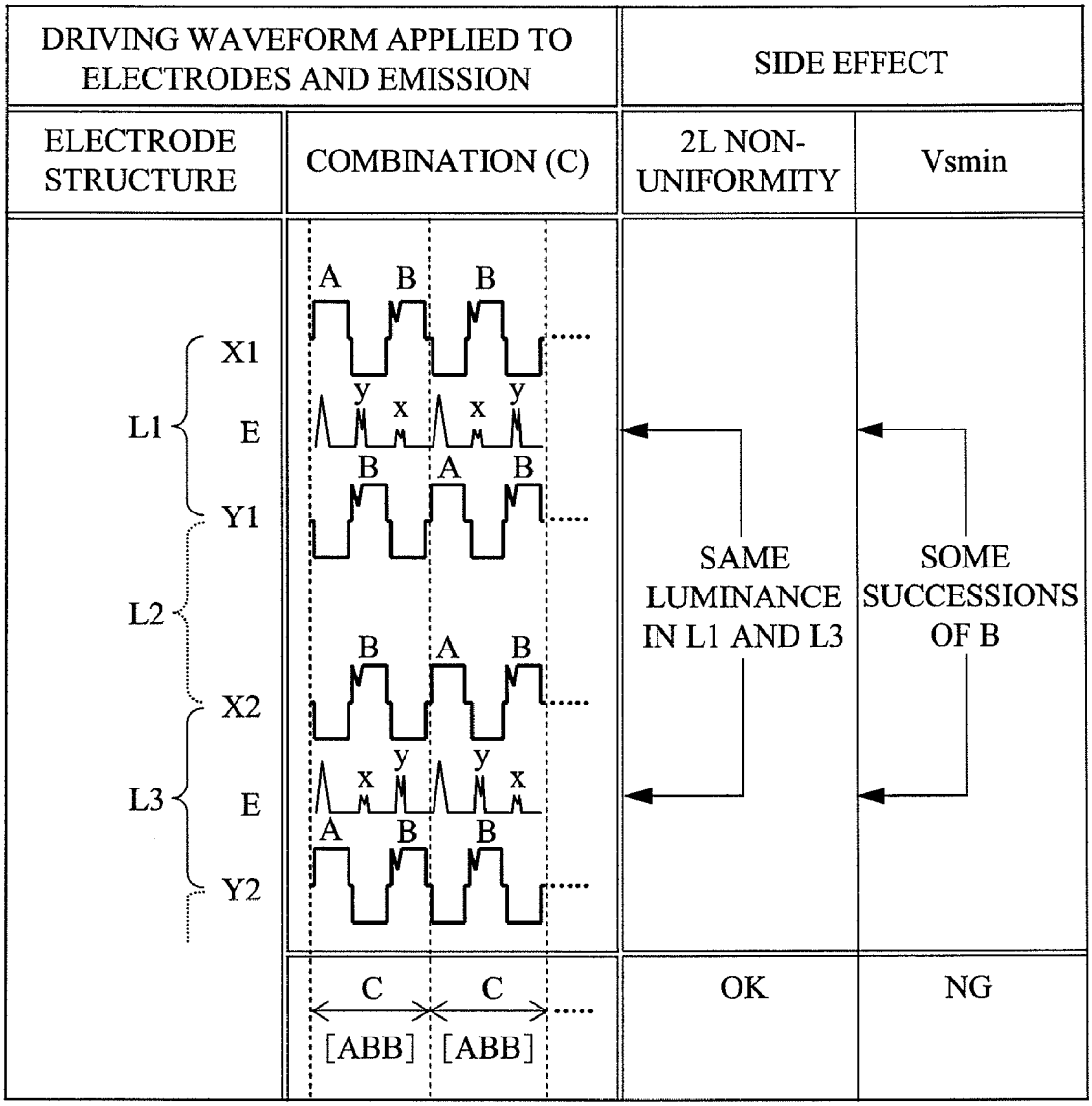
FIG. 11 is a diagram showing driving waveforms applied to electrodes, discharge emission, combination, effects and others as a sustain operation in the second conventional technology.
Figure 12:
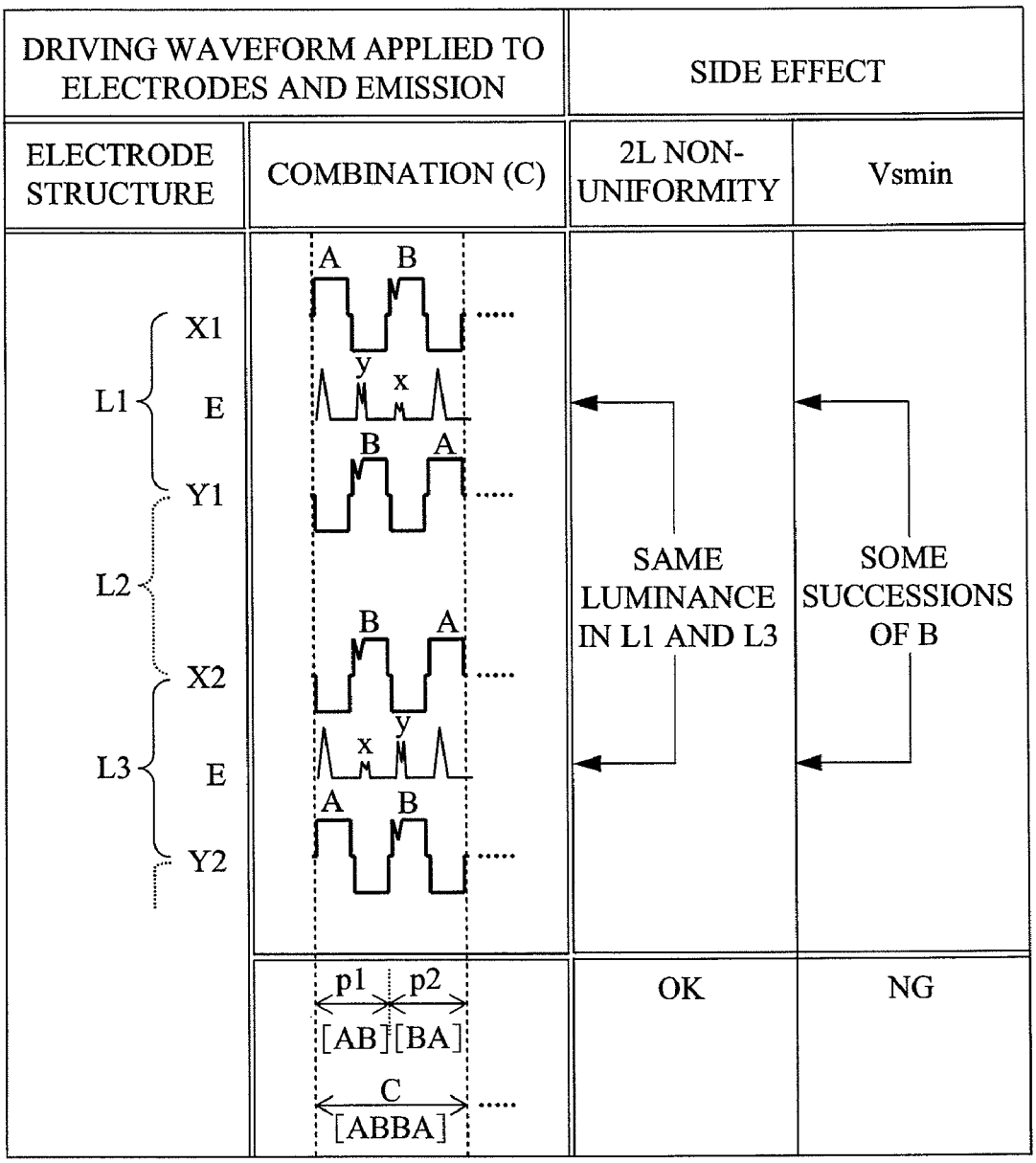
FIG. 12 is a diagram showing driving waveforms applied to electrodes, discharge emission, combination, effects and others as a sustain operation in the third conventional technology.

In this embodiment, FIG. 1 shows an overall structure of a PDP device, FIG. 2 shows an example of a structure of a PDP device, FIG. 3 shows a field and subfields (abbreviated as SF), FIG. 4 shows an example of driving waveforms thereof, FIG. 5 shows a sustain pulse generating circuit, FIG. 6 shows a first-type waveform (A) serving as a constituent element of a sustain operation, FIG. 7 shows a second-type waveform (B) serving as a constituent element of a sustain operation, FIG. 8 shows a sustain operation according to the first embodiment, and FIG. 9 schematically shows features of the respective embodiments. Also, FIG. 10 to FIG. 12 show the structures of the sustain operations in the conventional technologies (first to third conventional technologies) used for the comparison with the present invention.

A basic structure of a PDP device and a driving method thereof according to this embodiment will be described with reference to FIG. 1 to FIG. 4. The PDP device and the driving method thereof have the structure of the conventionally-known ALIS system.

<PDP Device>

In FIG. 1, the PDP device (PDP module) has a PDP 10 and circuit units for driving and controlling the PDP 10. The PDP module is held by attaching the PDP 10 to a chassis unit (not shown), the circuit units are formed of ICs, and the PDP 10 and the circuit units are electrically connected to each other. Furthermore, the PDP module is placed in an external chassis, thereby forming a PDP device (product set).

The circuit units include a control circuit 110 and driving circuits (drivers). The driving circuits are an X driving circuit 121, a Y driving circuit 122, a scan driver (scan driving circuit) 123, and an A (address) driving circuit 125. In this case, although the Y driving circuit 122 is used to commonly drive the Y electrodes 22 and the scan driver 123 is used to individually drive the Y electrodes 22, they may be combined and considered as one driving circuit for Y electrodes.

Display cells (C) of the PDP 10 are formed at intersections between rows (line: L) of the X electrodes (sustain electrode) 21 and the Y electrodes (scan electrode) 22 disposed in parallel to each other and columns of the A (address) electrodes 25 disposed orthogonally to the X and Y electrodes. The electrodes are connected to their corresponding driving circuits and are driven by driving waveforms from the driving circuits. The driving circuits are connected to the control circuit 110 and are controlled by control signals.

The control circuit 110 controls the entire PDP device including the respective driving circuits. Vsync (vertical synchronizing signal), Hsync (horizontal synchronizing signal), CLK (clock), D (display data) and others are inputted to the control circuit 110. The control circuit 110 generates control signals, display data (field and SF data) and others for driving the PDP 10 based on the display data (D) and outputs them to the respective driving circuits. Also, power source circuits (not shown) supply the power to respective circuits such as the control circuit 110.

The X driving circuit 121 includes a sustain pulse (Vs) circuit 131 and a reset and address voltage (Vx) generating circuit 133. The Y driving circuit 122 includes a sustain pulse (Vs) circuit 132 and a reset and address voltage (Vw) generating circuit 134. The sustain pulse circuit 131 generates a sustain pulse (Px) to be applied to the X electrodes 21 from the sustain voltage (Vs). The sustain pulse circuit 132 generates a sustain pulse (Py) to be applied to the Y electrodes 22 from the sustain voltage (Vs). The reset and address voltage (Vx) generating circuit 133 generates a reset and address voltage (Vx) to be applied to the X electrodes 21. The reset and address voltage (Vw) generating circuit 134 generates a reset and address voltage (Vw) to be applied to the Y electrodes 22.

In the ALIS system, as display rows each formed of a pair of adjacent X and Y electrodes, a display area of the PDP 10 including n lines of X electrodes 21 and n lines of Y electrodes 22 has odd-numbered lines (L1, L3, . . . , L2n-1) and even-numbered lines (L2, L4, . . . , L2n). Also, as display columns, the display area of the PDP 10 has columns of R, G, and B formed of m lines of A electrodes 25.

<PDP>

Next, an example of a panel structure of the PDP 10 (AC surface discharge structure, three electrode structure, and stripe rib structure) will be described with reference to FIG. 2. FIG. 2 shows a part corresponding to a pixel. The PDP 10 is formed by combining a structure (front surface unit 201) on a front substrate 11 mainly made of glass and a structure (rear surface unit 202) on a rear substrate 12 mainly made of glass opposite to each other, sealing their peripheral parts, and filling discharge gas such as Ne—Xe in the spaces therebetween.

In the front surface unit 201, a plurality of X electrodes 21 and Y electrodes 22 which are the electrodes (display electrode) for performing sustain discharge extend in parallel in a first direction (lateral direction) at predetermined intervals on the front substrate 11 and are alternately formed in a second direction (longitudinal direction). These display electrodes (21 and 22) are covered with a first dielectric layer 23, and a surface of the first dielectric layer 23 on a side of the discharge space is covered with a protective layer 24 made of MgO or the like. The display electrodes (21 and 22) are formed from bus electrodes which have a linear shape and are made of metal and transparent electrodes which are electrically connected to the bus electrodes and form discharge gaps between adjacent electrodes.

In the rear surface unit 202, a plurality of address electrodes 25 extending in the second direction are formed in parallel on the rear substrate 12. Further, the address electrodes 25 are covered with a second dielectric layer 26. Barrier ribs (vertical rib) 27 extending in the second direction are formed on both sides of the address electrode 25, and the ribs separate the display area in the column direction. Furthermore, on an upper surface of the second dielectric layer 26 on the address electrodes 25 and on the side surfaces of the barrier ribs 27, phosphors 28 for respective colors which are excited by ultraviolet ray to generate visible lights of red (R), green (G), and blue (B) are coated separately for each column. A pixel is formed from a set of the cells (C) for R, G, and B. The structure of the PDP is changed depending on the driving method and others.

<Field and Driving Waveform>

Next, an example of a field in a drive control of the PDP 10 and a basic driving waveform thereof will be described with reference to FIG. 3 and FIG. 4. This driving method is a commonly-known address display separation method.

In FIG. 3, one field (also referred to as frame) 300 which serves as a image display unit corresponding to a display area (screen) and a period of the PDP 10 is expressed as, for example, 1/60second. The field (F) 300 includes a plurality (m) of SFs (also referred to as subframe) 310 obtained by dividing the field based on time for the grayscale expression (multiple grayscales). For example, the field 300 is composed of ten SFs 310 from SF1 to SF 10. Each of the SFs 310 includes a reset period (TR) 321, a subsequent address period (TA) 322, and a subsequent sustain period (TS) 323. Weighting based on the length of TS 323, in other words, weighting based on the number of times of sustain discharges (number of sustains) Ns is given to each SF 310 of the field 300, and the grayscale of the cell (pixel) is expressed by the combination of On/Off of each SF 310 of the field 300.

FIG. 4 schematically shows the driving waveforms to be applied to respective electrodes of the PDP 10, that is, the A electrodes 25, the X electrodes 21, and the Y electrodes 22 (for example, X1, Y1, X2, and Y2 corresponding to three lines (L1 to L3)) in each of the SFs 310 ("SF1" to "SFm") of a certain field 300 "Fn" and a subsequent field 300 "Fn+1".

The specific operation thereof will be described below. When Vsync is inputted to the control circuit 110 from outside, the operation in accordance with the driving waveforms shown in FIG. 4 is started.

First, each of the cells of the field 300 retains different amount of wall charges depending on the display state of the previous field 300. Therefore, in the initial TR 321 of the SF 310, all of the cells are brought into an almost uniform state to prepare for the operation of the subsequent TA 322. The TR 321 is composed of two waveforms such as a write reset waveform (R1) and a compensation reset waveform (R2) and corresponding two periods in general. The write reset waveform (R1) is the waveform for generating (accumulating) a large amount of wall charge for all cells. The compensation reset waveform (R2) is the waveform for removing unnecessary charge from the large amount of wall charge written by R1 and adjusting the wall charge to be uniform in all cells in order to set the charge amount suitable for the address discharge according to the display data. For example, minute charge is generated in the cells by the application of the reset waveforms (R1 and R2) including oblique waves to the display electrodes (21 and 22).

In the next TA322, based on the display data (SF data), address discharge is performed only in the selected cells to be lit in the cell group in the SF 310 and the wall charge enough to perform the sustain discharge is accumulated. Based on the display data (SF data), a scan pulse 62 (voltage: −Vs) is applied to the Y electrodes 22 of the arbitrarily selected lines, a predetermined voltage (Vs+Vx) is applied to the X electrodes 21, and also, at the timing corresponding thereto, an address pulse 41 (voltage: Va) is applied to the selected address electrodes 25. By this means, the address discharge is generated in the selected cells.

In the next TS 323, simultaneously in all of the cells, the pair of sustain pulses (53 and 63) is repeatedly applied between the display electrodes (21 and 22) as many times as the number of sustains in accordance with the weighting of the SF 310 while alternately inverting the polarity thereof (voltage: Vs, −Vs). By this means, the sustain discharge (represented by a circular mark) is generated only in the selected cells having a large amount of charge by the address discharge in the previous TA 322. By this sustain discharge emission, the user can recognize the luminance.

The second and subsequent SFs 310 (SF2 to SFm) are the same as SF1 other than the number of sustains (Ns). TR 321 is the same in each of the fields 300 and the SFs 310. In TA 322, the operation depending on the driving lines is performed. As the sustain pair 31, an example of the successive two sustain pulse pairs (53 and 63) for the driving lines (X1-Y1) is shown.

In the ALIS system, a waveform of a field 300 (Fn+1) subsequent to a certain field 300 (Fn) is partly different from a waveform of the field 300 (Fn). More specifically, the driving waveforms applied to X electrodes 21, for example, X1 and X2 are changed. In other words, the interlace drive in which the lines (slit) to be driven are alternately switched between the odd-numbered line and the even-numbered line in units of the field 300 is used. Thus, in the field 300 (Fn), the drive display (sustain discharge emission of the selected cells) is performed in odd-numbered lines such as L1 of X1-Y1 and others, and in the subsequent field 300 (Fn+1), the drive display is performed in even-numbered lines such as L2 of Y1-X2 and others where the drive display is not performed in the previous field 300 (Fn). The ALIS system as described above has a significant merit that the size of the driving circuits and the address time can be reduced to about half in comparison to those of the conventional technology.

<Waveform A>

Next, sustain operations by the first-type waveform (A) and the second-type waveform (B) which serve as the constituent elements used in the embodiment of the present invention will be described with reference to FIG. 5 to FIG. 7. FIG. 5 shows a basic structure of a sustain pulse generating circuit 400 for generating and outputting sustain pulses. Note that the structure of the sustain pulse generating circuit 400 in this embodiment shown in FIG. 5 is basically the same as that of the conventional technology, and the difference therebetween lies mainly in the control thereof. In FIG. 6, as a basic sustain pulse in a sustain operation which does not use the technology described in the Patent Document 1, the rising part of the first-type waveform (A) is shown. In FIG. 7, as a sustain pulse in a sustain operation in which the technology of the Patent Document 1 is applied to the basic structure of FIG. 6 (waveform (A)), the rising part of the second-type waveform (B) is shown in the same manner. The reference character E indicates the discharge emission and its intensity by the driving waveform (Px/Py). LU and CU represent ON (H) /OFF (L) states of the switching elements in an LU circuit 401 and a CU circuit 402.

In the technology of the waveform (A) in FIG. 6, when the LU circuit (first switching element) 401 is turned ON in the sustain pulse generating circuit 400 in FIG. 5, current flows from GND (ground) via a coil La. At this time, by the LC resonance between the coil La and a panel capacitor Cc, the rising waveform becomes a curve whose gradient gradually decreases along with time as shown between timings t1 and t2 in FIG. 6.

Next, when the CU circuit 402 is turned ON after a lapse of a predetermined time from the turning ON of the LU circuit 401 (t2), the panel capacitor Cc is directly connected to a Vs power source. Therefore, as shown between timings t2 and t3 in FIG. 6, the voltage rapidly increases to Vs. The discharge firing voltage (voltage at which discharge is started) is V1≈Vs. Immediately thereafter, the discharge is performed, and the discharge emission waveform (E) at this time has almost one peak (t3 to t5). This discharge emission waveform (E) reaches its one discharge peak 511 (t4) when the voltage drops slightly from the discharge start (t3), and it gradually converges (t5) as the voltage becomes stable at Vs. The falling of the waveform is performed in order of the CD circuit 404 and the LD circuit 403. However, the description thereof is omitted here because its principle is equal to that of the rising.

<Waveform B>

Next, the technology of the waveform (B) in FIG. 7 is the method for improving the luminous efficacy by separating the peak of the sustain discharge into two peaks. The difference in the circuit control between the technology of the waveform (A) in FIG. 6 and the technology of the waveform (B) in FIG. 7 lies in the time difference between the time when LU is turned ON and the time when CU is turned ON, and this time difference is lengthened in the waveform (B) in FIG. 7 in comparison to that in the waveform (A) in FIG. 6. By this means, a large difference is caused in the discharge phenomenon. More specifically, while the discharge emission waveform (E) of the waveform (A) in FIG. 6 has almost one peak, the emission (E) of the waveform (B) in FIG. 7 has two separate discharge peaks (521 and 522).

Specifically, the two discharge peaks (521 and 522) are generated by the following processes (P0 to P4).

(P0) When the LU circuit 401 is turned ON (t1), the voltage value of the waveform (Px/Py) is increased by the LC resonance along with a curve whose gradient gradually decreases.

(P1) In the state where the LU circuit 401 is turned ON, the discharge is started at a predetermined discharge firing voltage Vi=V2 (t3). As the time difference, (t3−t1)>(t2−t1) should be satisfied. Also, V2<Vs should be satisfied.

(P2) Immediately after the start of the discharge (E), the discharge decrease due to the voltage drop occurs and the first discharge peak (521) is formed (t11).

(P3) Before the discharge (E) completely converges, the CU circuit 402 is turned ON (t12).

(P4) In the state where the CU circuit 402 is turned ON, the discharge (E) is revived. That is, the intensity of the discharge (E) is increased again. When the voltage value of the waveform (Px/Py) increases up to Vs (t13) and then slightly drops, the second discharge peak (522) is formed (t14). Thereafter, the discharge (E) gradually converges (t15) as the voltage value becomes stable at Vs.

As described above, by forming the two discharge peaks (521 and 522) in the single driving waveform (Px/Py), although the single luminance of the sustain discharge is decreased, the current for emission can be reduced more than that. As a result, the emission efficacy can be improved, and this is confirmed in an experiment.

In the technology of the waveform (A) in FIG. 6, the discharge firing voltage (Vi) is almost equal to the sustain voltage Vs. Therefore, this technology has an advantage that the probability of the discharge failure is low. Meanwhile, in the technology of the waveform (B) in FIG. 7, the discharge firing voltage (Vi) is the voltage (V2) which is lower than the sustain voltage (Vs). In the case of the waveform (B), the emission efficacy can be improved, but it also has the disadvantage that the minimum necessary sustain voltage (Vsmin) is increased due to the weakening of the discharge. That is, it is necessary to set the minimum necessary sustain voltage (Vsmin) to be high enough to stabilize the discharge. More specifically, the sustain voltage (Vs) is 82 V and the minimum necessary sustain voltage (Vsmin) is 79 V.

In the case of the structure described above, with respect to the two types of electrodes (X electrode 21 and Y electrode 22) where the sustain discharge is mainly performed, the discharge is started when the potential of one electrode is changed from −Vs to +Vs. However, it is not meant to be restrictive, and the structure where the discharge is started when the potential is changed from +Vs to −Vs and the structure where the discharge is started when the potential is changed from ±Vs to GND are also possible.

Next, for the comparison with the embodiment of the present invention, examples of the sustain operation in the conventional technologies (first to third conventional technologies) in which sustain discharges are generated by combining the waveform (A) in FIG. 6 and the waveform (B) in FIG. 7 will be described with reference to FIG. 10 to FIG. 12.

<First Conventional Technology>

In an example shown in FIG. 10 (first conventional technology), in an ALIS PDP device, the waveforms A and B are alternately applied to the display electrodes (X and Y electrodes) at a rate of 1:1. For example, with respect to the line L1 of the display electrodes X1-Y1, first, the waveform A is applied by a pair (sustain pulse pair) so that X1 shows a positive polarity and Y1 shows a negative polarity, and then, the waveform B is applied to Y1 so that Y1 shows a positive polarity (waveform A to the other X1). The sustain pair (p1) including the waveforms A and B as its elements is considered as one combination (periodic combination). The p1=[AB] (application set in order of A, B) is repeatedly applied in the combination (C).

As a basis of the sustain operation, the sustain pulse pair with opposite polarities is applied to the display electrode pair to be driven, and the sustain pulse whose polarity is inverted along with time is repeatedly applied alternately to the X and Y electrodes. Further, the successive two sustain pulses (sustain pulse pair) whose polarity is inverted to be applied to the display electrodes or the pair thereof are considered as one unit (referred to as sustain pair).

In the case of the first conventional technology, the discharges (x and y) by the waveform B does not occur successively. Therefore, the side effect of the deterioration of the minimum necessary sustain voltage (Vsmin) can be prevented. However, in the case where the first conventional technology is applied to the ALIS system as shown in FIG. 10, a significant problem occurs in image quality. This is because, since the impedance is different in the drive circuit of the Y electrode and the drive circuit of the X electrode, the single luminance (emission luminance of one sustain discharge by sustain pulse pair) differs even under the same conditions.

More specifically, there are the discharge (y) from Y1 to X1 by the waveform B where Y1 shows a positive polarity and the discharge (x) from X2 to Y2 by the waveform B where X2 shows a positive polarity. In spite of the sustain discharge by the application of the same waveform B, the discharge (y) is slightly stronger and brighter than the discharge (x). Accordingly, the luminance between X1 and Y1 (L1) is higher than the luminance between X2 and Y2 (L3). As a result, in the driving line (L) group, one line becomes a bright line and the other line becomes a dark line in every 2L, that is, striped patterns due to the luminance nonuniformity (referred to as 2L nonuniformity) are observed.

<Second Conventional Technology>

In an example shown in FIG. 11 (second conventional technology), in an ALIS PDP device, one combination of the waveforms A and B, that is, the combination C=[ABB] (application in order of A, B, B) is repeatedly applied to the display electrodes (X and Y electrodes). By this means, three types of discharges, that is, the discharge of the waveform A, the relatively strong discharge of the waveform B (y), and the relatively weak discharge of the waveform B (x) are generated. In this case, since the number of waveforms constituting one combination (C=[ABB]) is an odd number (three), the number of times of the three types of discharges is equal in the driving line group, for example, in L1 and L3.

Accordingly, the second conventional technology has the advantage that the 2L nonuniformity mentioned above does not occur. However, since the discharges of the waveform B (x and y) occur successively, the minimum necessary sustain voltage (Vsmin) is deteriorated and is not practical.

<Third Conventional Technology>

The example shown in FIG. 12 (third conventional technology) is described in Japanese Patent Application Laid-Open Publication No. 2001-13913 (Patent Document 2), in which two types of waveforms (sustain pair) are alternately applied. In this case, two sustain pairs (sub-combination), that is, p1=[AB] (application in order of A, B) and p2=[BA] (application in order of B, A) are applied alternately and repeatedly. In other words, one combination (main combination) of C=[ABBA] (application in order of A, B, B, A) including the above-mentioned elements (p1 and p2) is repeatedly outputted.

Similar to the second conventional technology, the third conventional technology has the advantage that the 2L nonuniformity can be prevented because the number of times of the three types of discharges is equal in the driving line group, but it also has the disadvantage that the minimum necessary sustain voltage (Vsmin) is deteriorated and is not practical because the discharge of the waveform B occurs successively.

In the technology described in the Patent Document 2, in order to prevent the fluctuation in luminance due to the unstable change of the bias of the neon emission toward the X electrode side or the Y electrode side, two types of waveforms (corresponding to sustain pairs [AB] and [BA] in the third conventional technology) are alternately applied. Therefore, the technology described in the Patent Document 2 is different from the technology for the ALIS system according to the embodiment of the present invention in their object, structure, and effect, for example, the mechanism of generating the luminance nonuniformity and the luminance fluctuation.

First Embodiment

Next, an sustain operation and others characterizing the PDP device of the first embodiment will be described with reference to FIG. 5 and FIG. 6. In the first embodiment, there are few points where the waveform B occurs successively in the combination using the waveforms A and B, and the number of times of the various types of discharges is made equal in the driving line group by combining reversed sub-combinations.

<Sustain Pulse Generating Circuit>

First, the structure of the sustain pulse generating circuit 400 will be described with reference to FIG. 5. This sustain pulse generating circuit 400 corresponds to the sustain pulse (Vs) circuits 131 and 132 of the X driving circuit 121 and the Y driving circuit 122 in FIG. 1. The sustain pulse generating circuit 400 is connected to each panel capacitor Cc corresponding to the cell of the PDP 10. In the structure of the sustain pulse generating circuit 400, the positive and negative sustain voltage (Vs and −Vs) power sources and the power recovery circuit 410 are incorporated or connected. Further, as switches for controlling the driving waveforms, the sustain pulse generating circuit 400 has the LU (LC resonance Up) circuit 401 including a first switching element 411, the CU (Clamp Up) circuit 402 including a second switching element 412, the LD (LC resonance Down) circuit 403 including a third switching element, and a CD (Clamp Down) circuit 404 including a fourth switching element.

The LU circuit 401 and the LD circuit 403 are the circuits for controlling the LC resonance operation in the power recovery circuit 410. The CU circuit 402 and the CD circuit 404 are the circuits for controlling the voltage clamp operation connected to the positive and negative sustain voltage (Vs and −Vs) power sources and the panel capacitor Cc. The LU circuit 401 and the CU circuit 402 relate to the rising of the driving waveform, and the LD circuit 403 and the CD circuit 404 relate to the falling of the driving waveform. The LU resonance is the resonance between the coils La and Lb and the panel capacitor Cc.

The first to fourth switching elements 411 to 414 are configured of FET (Field Effect Transistor) and others. For example, "LU" in the LU circuit 401 represents a control input of ON/OFF of the first switching element 411, and it is true of other switching elements.

In a FET which is the first switching element 411 of the LU circuit 401, a drain is connected to GND, a source is connected to the coil L1 via a diode, and a gate is the control input "LU". The control input "LU" is an LU ON/OFF signal supplied from a logic circuit and a pre-driver (not shown). According to this control input "LU", the state of the FET which is the first switching element 411 is changed between a shorted/connected (LU ON) state and a disconnected (LU OFF) state. Similarly, the LD circuit 403 is connected to GND and the coil Lb, and LD ON/OFF is controlled by the control input "LD".

In a FET which is the second switching element of the CU circuit 402, a drain is connected to a Vs (positive sustain voltage) power source via a diode, a source is connected to the panel capacitor Cc, and a gate is the control input "CU". The control input "CU" is a CU ON/OFF signal supplied from a logic circuit and a pre-driver (not shown). Similarly, the CD circuit 404 is connected to the −Vs (negative sustain voltage) power source and the panel capacitor Cc, and CD ON/OFF is controlled by the control input "CD".

<Sustain Operation>

Next, the sustain operation in the PDP device according to the first embodiment will be described with reference to FIG. 8 and others. FIG. 8 shows driving waveforms to be applied to the lines (for example, L1, L2, and L3) of the X electrodes 21 and the Y electrodes 22 (for example, X1, Y1, X2, and Y2), the discharge emission thereof (E), the combination (C) of the waveforms A and B, and the effect of the 2L nonuniformity and Vsmin. In the sustain pulse generating circuit 400 in FIG. 5, by the operation for controlling such switches as LU and CU, the waveform (A) in FIG. 6 and the waveform (B) in FIG. 7 are generated and outputted, and then applied to the display electrodes (21 and 22).

The first embodiment is characterized by the structure where the combination (C1) formed of the two types of waveforms A and B is repeatedly applied, and as the combination (C1), the sustain pair (p1) of [AB] (application in order of A, B) is repeated two or more times (×k), and then, the sustain pair (p2) of [BA] (application in order of B, A) which is reverse to the sustain pair (p1) is repeated two or more times (×k).

Further, the main combination (C1) is composed of sub-combinations (SC) with a shorter period, that is, SC1=[AB×k] and SC2=[BA×k]. Also, these sub-combinations (SC1 and SC2) are composed of the repetition of the sustain pairs, which are the sub-combinations with a further shorter period, that is, p1=[AB] and p2=[BA].

In the ALIS system, the driving in which the line (slit) to be driven is changed in units of the field 300 (so-called interlace drive) is performed. To the driving lines (positive slit), for example, odd-numbered lines of the field (Fn) 300, the sustain pulse pair (53 and 63) is applied so that the X electrode 21 and the Y electrode 22 show opposite polarities. To the non-driving line (reverse slit), for example, even-numbered lines of the field (Fn) 300, the sustain pulse pair is applied so that the X electrode 21 and the Y electrode 22 show the same polarity. In the case illustrated here, the odd-numbered lines (L1, L3, . . . ) are to be driven. In this case, the discharge is not generated in the even-numbered lines (L2, L4, . . . ) because the sustain pulse pair shows the same polarity.

In the application of the combination (C1), three types of discharges, that is, the discharge of the waveform A, the relatively strong discharge of the waveform B, and the relatively weak discharge of the waveform B are generated. When the waveform (B) is to be applied to the display electrodes (21 and 22), the intensity of the sustain discharge differs depending on whether the X electrode 21 shows the positive polarity or the Y electrode 22 shows the positive polarity. The single luminance by the waveforms (A and B) is highest in the discharge of the waveform A, and second highest in the discharge (y) of the waveform B in which the Y electrode 22 shows the positive polarity, and lowest in the discharge (x) of the waveform B in which the X electrode 21 shows the positive polarity.

In this structure, the number of times of these three types of discharges is equal in the driving line group, for example, in L1 and L3, and the total luminance is also equal. Therefore, the 2L nonuniformity described above can be prevented.

In more detail, in respective sub-combinations (SC1 and SC2), since the number of waveforms constituting the same is an even number, the number of times of the three types of discharges differs in the driving lines, for example, in L1 and L3, and therefore, the luminance differs. Further, when the sub-combination is changed, the waveforms and the discharges are reversed from those of the previous sub-combination. For example, in the sub-combination SC1, the discharge (y) is generated in L1 and the discharge (x) is generated in L3. In the subsequent sub-combination SC2, the discharge (x) is generated in L1 and the discharge (y) is generated in L3 because the waveforms and the discharges are reversed. Accordingly, the total luminance in units of the combination (C1) is equal in the driving line group.

Further, in this structure, the number of points where the waveform B occurs successively and the probability of the occurrence thereof in the combination (C1) and its repetition will be described. In this structure, the point where the waveform B occurs successively appears only at the point where the sub-combination (SC1 and SC2) is changed from SC1 to SC2. Therefore, the number of points is small and the occurrence probability thereof is low. In other words, the probability that the waveform B and its discharge (x, y) occur successively in the driving waveform group is low. Specifically, the probability is lower than 20%.

Therefore, the deterioration in Vsmin hardly occurs. The higher the occurrence probability of the point where the waveform B occurs successively becomes, the more conspicuous the deterioration in Vsmin is. According to the experiment by the inventors of the present invention, no problem is caused in a practical use if the probability is less than 20%. Since the probability that the point where the waveform B occurs successively appears in the second conventional technology is 33% and the probability in the third conventional technology is 25%, the problem in a practical use is caused therein.

As described above, according to the first embodiment, by the control of the combination of the waveforms A and B, the disadvantages of the 2L nonuniformity and the deterioration in Vsmin can be suppressed or reduced, and thus, the luminous efficacy can be improved.

Second Embodiment

Next, the PDP device according to the second embodiment of the present invention will be described with reference to FIG. 9 and others. In (1) of FIG. 9, the feature and the specific example of the first embodiment described above are described in brief. Also, in (2) to (4), the feature and the specific example of the second to fourth embodiments are described. The basic structure of the second to fourth embodiments is the same as that of the first embodiment.

The number of sustain pairs in "SF1" which is the first SF 310 of the field 300 is 8 (the number of sustain pulses is 16). Meanwhile, in the first embodiment shown in (1), for example, when k=3, the combination is C1=[AB], [AB], [AB], [BA], [BA], [BA], and the number of sustain pairs constituting C1 is 6. Although C1 is repeated in the SF 310, the number of sustain pairs of "SF1" is larger than that of C1 by two pairs. This surplus of the two sustain pairs (C1) becomes a factor to generate the 2L nonuniformity though it is extremely slight. At the end of "SF1", the sequence of C1 is stopped halfway. That is, C1' includes only [AB] and [AB]. Then, similar to "SF1", "SF2" starts from the top of the combination (C1) in order of [AB], [AB], [AB], [BA], . . . , The second embodiment relates to the method for removing the problem of the factor described above. The difference between the first embodiment and the second embodiment lies in the start of "SF2" which is the subsequent SF 310 in the field 300. Specifically, different from the first embodiment, in the second embodiment shown in (2), "SF2" starts by taking over the final sequence (surplus) of "SF1". In other words, the combination (C1) is repeated without breaking it between SFs 310. That is, "SF2" starts from the middle of the C1' mentioned above in order of [AB], [BA], [BA], [BA], . . . . By this means, C1 including the surplus (C1') in "SF1" is incorporated in "SF2", and the slight 2L nonuniformity in the first embodiment is completely removed in the second embodiment. "SF2" to "SFm" also have the same structure described above. In this manner, the second embodiment is advantageous particularly for the 2L nonuniformity.

Third Embodiment

Next, the PDP device according to the third embodiment of the present invention will be described with reference to FIG. 9 and others. In the specific examples shown in FIG. 9, the probability that the waveform B occurs successively is 8% in the first embodiment shown in (1). The point where the waveform B occurs successively is only the point of changing the sub-combinations (SC1 and SC2) in C1. Therefore, the increase of Vsmin in consideration of the succession of the waveform B is not observed (unnecessary) in the experiment, but there is a risk of the increase in principle.

In the third embodiment shown in (3), based on the structure of the first embodiment, only when the waveform B occurs successively, the latter waveform B thereof at that point is exchanged to the waveform A as an exception. Since the waveform B occurs successively such as [AB], [BA] at the point of change of the sub-combinations (SC1 and SC2) in C1, this part is exchanged to [AB], [AA] in C1" as a substitute for C1. By this means, the probability that the waveform occurs successively becomes 0%, and the increase of Vsmin is completely disappear in principle. In this manner, the third embodiment is advantageous particularly for the Vsmin.

Fourth Embodiment

Next, the PDP device according to the fourth embodiment of the present invention will be described with reference to FIG. 9 and others. The fourth embodiment shown in (4) in FIG. 9 is an example where the second and third embodiments are combined. Specifically, "SF2" starts by taking over the final sequence (C1') of "SF1" in order of [AB], [BA],

[BA], [BA], and only when the waveform B occurs successively, the latter waveform B thereof at that point is exchanged to the waveform A so as to prevent the succession of the waveform B. That is, the part [AB], [BA] is exchange to [AB], [AA]. By this means, the problems of the 2L nonuniformity and the deterioration of Vsmin can be completely solved in the fourth embodiment.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be applied to a PDP device.

What is claimed is:

1. A driving method of a plasma display panel, in which driving waveforms are applied to at least two types of display electrodes to perform display sustain discharges between the two types of display electrodes, wherein a drive control in a sustain operation period in a plurality of subfields obtained by dividing one field corresponding to a predetermined display period based on time for grayscale expression is performed, as driving waveforms for the sustain discharges between the two types of electrodes, a driving waveform by a periodic first combination in which at least two or more types of waveforms including a first-type waveform and a second-type waveform are mixed is sequentially applied to the two types of display electrodes, the first combination is comprised of a plurality of subsidiary combinations having a shorter period than that of the first combination, and probability that the second-type waveform is applied successively in the first combination is less than 20%.

2. The driving method of a plasma display panel according to claim 1, wherein, in a structure of the first combination, the number of time of sustain discharges of various intensities by the two or more types of waveforms and total luminance thereof are made almost equal in a display line group to be driven.

3. The driving method of a plasma display panel according to claim 1, wherein the plurality of subsidiary combinations are mainly formed by alternate repetition of the first-type waveform and the second-type waveform, and in a first subsidiary combination and a second subsidiary combination of the plurality of subsidiary combinations, arrangement of the first-type waveform and the second-type waveform is revered.

4. The driving method of a plasma display panel according to claim 1, wherein the first combination is comprised of the first and second subsidiary combinations, the first subsidiary combination is formed by two or more repetitions of a pair of the first-type waveform and the subsequent second-type waveform, and the subsidiary combination subsequent to the first subsidiary combination is formed by two or more repetitions of a pair of the second-type waveform and the subsequent first-type waveform.

5. The driving method of a plasma display panel according to claim 1, wherein the first-type waveform is a waveform for generating a sustain discharge having one discharge peak, and the second-type waveform is a waveform for generating a sustain discharge relatively weaker than the first-type waveform and having two discharged peaks.

6. The driving method of a plasma display panel according to claim 5, wherein the two-types of electrodes are X electrodes for sustain driving and Y electrodes for sustain and scan driving, and by application of the first combination, sustain discharge of the first-type waveform, relatively weak discharge of the second-type waveform in which the X electrode shows positive polarity, and relatively strong discharge of the second-type waveform in which the Y electrode shows positive polarity are generated.

7. A driving method of a plasma display panel, in which driving waveforms are applied to at least two types of display electrodes to perform display sustain discharges between the two types of display electrodes, wherein, as driving waveforms applied to the two types of display electrodes for generating sustain discharges in a sustain operation period in a field and a subfield, a driving waveform by a periodic first combination in which at least two or more types of waveforms including a first-type waveform and a second-type waveform are mixed is sequentially applied to the two types of display electrodes, the first combination is comprised of a plurality of subsidiary combinations having a shorter period than that of the first combination, and second and subsequent subfields in the field start by taking over surplus of the first combination of their previous subfields.

8. A driving method of a plasma display panel, in which driving waveforms are applied to at least two types of display electrodes to perform display sustain discharges between the two types of display electrodes, wherein, as driving waveforms applied to the two types of display electrodes for generating sustain discharges in a sustain operation period in a field and a subfield, a driving waveform by a periodic first combination in which at least two or more types of waveforms including a first-type waveform and a second-type waveform are mixed is sequentially applied to the two types of display electrodes, the first combination is comprised of a plurality of subsidiary combinations having a shorter period than that of the first combination, and in the first combination and repetition thereof, only in a point where the second-type waveform occurs successively, the latter second-type waveform is exchanged to the first-type waveform.

9. A plasma display device comprising: a plasma display panel in which at least two types of display electrodes are formed; and a circuit unit for driving and controlling the electrodes of the plasma display panel, in which display sustain discharges are performed between the two types of electrodes by applying driving waveforms from the circuit unit to the two types of electrodes, wherein a drive control in a sustain operation period in a plurality of subfields obtained by dividing one field corresponding to a predetermined display period of the plasma display panel based on time for grayscale expression is performed, as driving waveforms for the sustain discharges between the two types of electrodes, a driving waveform by a periodic first combination in which at least two or more types of waveforms including a first-type waveform and a second-type waveform are mixed is sequentially applied to the two types of display electrodes, the first combination is comprised of a plurality of subsidiary combinations having a shorter period than that of the first combination, and probability that the second-type waveform is applied successively in the first combination is less than 20%.

10. The plasma display device according to claim 9, wherein, in a structure of the first combination, the number of times of sustain discharges of various intensities by the two or more types of waveforms and total luminance thereof are made almost equal in a display line group to be driven.

11. The plasma display device according to claim 9, wherein second and subsequent subfields in the field start by taking over surplus of the first combination of their previous subfields.

12. The plasma display device according to claim 9, wherein, in the first combination and repetition thereof, only in a point where the second-type waveform occurs successively, the latter second-type waveform is exchanged to the first-type waveform.

* * * * *